US005323211A

United States Patent [19]

Fujii et al.

[11] Patent Number: 5,323,211

[45] Date of Patent: Jun. 21, 1994

[54] DRIVING DEVICE OF ROTATIONAL BODY FOR USE IN IMAGE FORMING APPARATUS

[75] Inventors: Yozo Fujii; Toru Makino; Tadashi Miwa, all of Hachioji, Japan

[73] Assignee: Konica Corporation, Tokyo, Japan

[21] Appl. No.: 57,089

[22] Filed: May 3, 1993

[30] Foreign Application Priority Data

Sep. 11, 1992 [JP] Japan ..... 4-269408
Sep. 11, 1992 [JP] Japan ..... 4-269410
Sep. 14, 1992 [JP] Japan ..... 4-271111

[51] Int. Cl.[5] ..... G03G 15/00

[52] U.S. Cl. ..... 355/200; 355/210; 248/562; 248/636; 248/638; 464/180; 74/409

[58] Field of Search ..... 355/200, 211, 210; 248/636, 638, 562; 464/180; 74/409

[56] References Cited

U.S. PATENT DOCUMENTS 4,120,576 10/1978 Babish .
4,671,645 6/1987 Saito et al. .
5,136,330 8/1992 Sato ..... 355/200
5,218,405 6/1993 Wong ..... 355/200

*Primary Examiner*—R. L. Moses
*Attorney, Agent, or Firm*—Jordan B. Bierman

[57] ABSTRACT

A driving device for a rotational photoreceptor drum for use in an image forming machine, in which a rotational drive from a motor is supplied through a gear train to the axial shaft of the drum. The shaft is connected to the drum only at the side farthest from the gear train. An inertia member is provided within the drum. A rotational member having a rotational resistance is brought in contact with a non-image region of the drum.

7 Claims, 13 Drawing Sheets

DRIVING DEVICE OF ROTATIONAL BODY FOR USE IN IMAGE FORMING APPARATUS

BACKGROUND OF THE INVENTION

The present invention relates to an image forming output apparatus such as a digital color copying apparatus, a digital color printer, and the like to which an electrophotographic process is applied.

In a copying apparatus or printer to which an electrophotographic process is applied, an image is formed in the following manner: a rotating cylindrical photoreceptor or a belt-shaped photoreceptor is rotated and electrostatic latent images are formed thereon successively; black toner and other color toners, in the case of color image formation, are adhered to the electrostatic latent images formed as described above for development; and they are transferred onto a recording sheet, thus, the image is obtained. In this specification, the photoreceptor drum in the image output apparatus and a driving roller for the belt-shaped photoreceptor are referred to as a rotational body. When the rotational speed of the photoreceptor drum is varied for some reasons, jittering or an uneven image is caused in the outputted image. These phenomena have remarkably appeared especially in the digital system electrophotographic technology employing scanning by means of a semiconductor laser for writing images on a photoreceptor. Fluctuation in rotational speed of the photoreceptor has caused speed fluctuation of a writing system in the subsidiary scanning direction to create a slight variation in the distance between writing lines, contributing to the remarkable deteriorations of the image quality.

Conventionally, when designing the driving system for use in a copying apparatus or a printer, the main consideration is that the objects driven by the driving device are appropriately located in the allowable space, while satisfying the values of the line speed or number of revolutions introduced from the product specification. That is, the following are main concerns: the method by which the driving power is transmitted from a driving power source to a driven object; and mechanical elements for power transmission. Accordingly, when jittering and rotational fluctuation are caused in the product, the cause is investigated, and one or more of the following countermeasures are considered: a bearing of a drive shaft of the photoreceptor is replaced with one made of sintered metal; a flywheel is connected with the drive shaft of the photoreceptor; a brake, in which a spring is combined with a friction material, is provided on the rotary shaft of the photoreceptor drum; the accuracy of a gear is enhanced; or a helical gear with various kinds of torsion angles is provided.

However, in the development of a digital type image output apparatus, strict reproducibility of a one dot line written by a laser beam is required with an improvement of the apparatus performance, and accuracy required on the driving system has rapidly become strict. The accuracy required is a level at which the uniformity of laser writing in the subsidiary scanning direction is assured in relation to the visible sensitivity of the visual system. In order to accomplish this accuracy, it is mostly necessary to make the photoreceptor driving system highly accurate. The main factor of the rotational fluctuation of the driving system is the following: the rotational fluctuation per one rotation of the rotating shaft of a motor is large, and absolute values of fluctuation components per one rotation of a gear and per one tooth of a gear are large; and fluctuation components and their higher harmonic wave components cause a resonance phenomenon in relation to the proper oscillation frequency of the driving system.

FIG. 14 shows the power spectrum of speed fluctuation of conventional apparatuses. In FIG. 14, fluctuation components of a gear according to the line speed proper to the apparatus are 176 Hz in the case of a gear directly coupled to the motor, 64 Hz in the case of a second shaft, and 25 Hz in the case of a gear directly coupled to a drum, and in this case, a higher harmonic wave component of 50 Hz is shown. Further, a component of a rotation of the gear directly coupled to the motor is 22 Hz, and its higher harmonic wave component of 44 Hz is shown in the drawing.

FIG. 15 shows an example in which a transfer function for obtaining numerically the proper oscillation frequency of the driving system was measured. In this case, the measurement was conducted in the following way: an output of an impact excitation hammer, and an output of a piezoelectric type pickup sensor, provided to one end of a photoreceptor drum in order to measure the fluctuation of the acceleration in the rotation direction, were connected with a dual channel type FFT analyzer; and a Fourier spectrum ratio was obtained. From FIG. 15, the following can be found: a peak of the proper oscillation frequency is near 45 Hz; and high level areas of the transfer function are spread to cover the range of 30 to 60 Hz.

FIG. 16 shows superimposition of the fluctuation component spectrum and the transfer function. In the driving system, it can be found from the drawing that a peak of the transfer function and the position of a frequency area, to which the fluctuation component and its second harmonics belong, are overlapped. That is, it is found that the driving system amplifies the fluctuation components (resonance is caused).

Actually, when measurement data from three apparatuses each having the present driving systems were investigated, the fluctuation of rotation of the photoreceptor showed values of 5 to 8%.

In order to solve the foregoing problems, in the present invention, decrease of the speed fluctuation of a motor and a gear was taken as a an assumption. Further, in addition to that, a driving device for a rotational body was constituted as follows, with the transmission of the fluctuation component in the driving power transmission system, and the concept of the transfer function, resonance and proper oscillation frequency as well as a method to reduce the transmitted fluctuation, all taken into consideration.

At first, in order to prevent the resonance of the driving system for the rotational body, matching of the proper oscillation frequency of the driving system with the frequency of the fluctuation component transmitted to the driving system was avoided. Generally, the proper oscillation frequency $\omega$ is expressed by the following equation.

$$\omega = \sqrt{\frac{K}{I}} \quad \text{[Equation 1]}$$

In the equation, K indicates the torsional rigidity of the driving system, and I indicates its moment of inertia.

In order to prevent the resonance, the value of $\omega$ can be changed by changing the value of K or I. In order to prevent the resonance, the value of $\omega$ may either be larger or smaller with respect to the fluctuation component of the driving system. In order to make the value of $\omega$ larger, the value of K is increased or the value of I is decreased. On the other hand, in order to make the value of $\omega$ smaller, the value of I is increased or the value of K is decreased.

With respect to the driving system having data shown in FIG. 14, FIG. 17 and FIG. 18 show the power spectrum of the rotational fluctuation and the actually measured value of the transfer function of the driving system in the case where the proper oscillation frequency is changed to a larger value and a smaller value by changing the structure of the driving system, wherein data are overlapped in the same manner as that in FIG. 16. FIG. 19 shows the comparison of peak values of the transfer function of the foregoing three driving systems. In FIG. 17, when the structure of the driving system is changed for decreasing the rigidity, the value of K, which is the torsional rigidity of the driving system, is decreased. When the data shown in FIGS. 17, 18 and 19 are compared with each other, the transfer function is decreased together with a change of the number of the proper oscillation in the case where the structure is changed in order to reduce the torsional rigidity K of the driving system so that the proper oscillation frequency is changed to a lower frequency side, wherein the proper oscillation frequency is changed in order to prevent the resonance. It is considered that the foregoing effect can be obtained in the following manner: when the structure is changed in order to change the proper oscillation frequency, the attenuation coefficient is increased due to the change to the flexible structure; and the structure is changed so that the rotational fluctuation is absorbed in the driving system itself. From above effects, the following is found: when the structure is changed in order to reduce the torsional rigidity K of the driving system in the case where the proper oscillation frequency is changed in order to prevent the resonance, the value of transfer gain of the fluctuation of the rotational speed is changed; and this is advantageous and effective in that the fluctuation of the speed of the driving system is decreased. On the other hand, when the structure is changed in order to reduce the rigidity K, the fluctuation of the speed is hardly absorbed in the case where force is instantaneously applied when a cleaning blade or the like, for example, is brought into contact with a member of the system, so that the above influence remains on the image for a long period of time.

In an image output apparatuses, especially in digital type image output apparatuses in which an image writing operation onto the photoreceptor is conducted by a laser beam, an image with high quality can not be obtained when the rotational body is not rotated constantly at a predetermined speed. When the rotational speed is changed, distance between scanning lines of the laser beam is different at each position, so that ununiform image density is generated. Further, in the case of a color image, colors, generally yellow, magenta, cyan, and black toners are superimposed, and therefore the color toner balance is lost and the color reproducibility is lowered.

However, when the impulsive force is applied to the rotational body of an image output apparatus, for example, a cleaning blade, which is used for wiping-off toners adhering to the photoreceptor surface, is sometimes brought into contact with the photoreceptor surface, upon which the periodical fluctuation of the rotational speed of the rotational body is generated. Further, the speed fluctuation remains for a long period of time, a long period of time is necessary for eliminating the speed fluctuation, and the image is largely disturbed during the time, which is a problem.

SUMMARY OF THE INVENTION

As a result of the foregoing, the first embodiment of the present invention is constituted as follows: the rotational body is connected with a driving shaft at a position which is far from the driving transmission system; a load having large inertia is provided in the rotational body so that the proper oscillation frequency of the rotational body is lowered; and a rotational member having rotational resistance is brought into contact with a non-image portion, that is, the portion which is not concerned with image formation on the rotational body.

The proper oscillation frequency can be separated from the frequency of the fluctuation component, and the resonance of the driving system of the rotational body can be prevented so that the speed fluctuation of the rotational body is decreased, due to the following reasons: the effective length of the driving shaft is long because the driving shaft is connected with the rotational body at a position which is far from the driving transmission system; rigidity K of a portion beyond the drive gear is actually decreased; moment of inertia I is increased because a load providing large inertia is provided to the rotational body, and therefore the proper oscillation frequency is decreased; and thereby the proper oscillation frequency of the driving system of the rotational body shown by Equation 1 is decreased. Further, rigidity K of the driving system of the rotational body is practically lowered, therefore the structure can be made flexible, the transfer gain of the driving system of the rotational body is decreased, and thereby a speed fluctuation level of the rotational body can be decreased. Further, since the rotational member having rotational resistance is in contact with the non-image portion of the rotational body, the speed fluctuation of the rotational body can be rapidly absorbed, and thereby the quality of outputted images can be greatly improved. Further, the device can be made smaller, the cost is decreased, and the reliability of the entire system can be increased.

The second embodiment of the present invention is constituted in the following manner: in order to rapidly absorb the speed fluctuation caused by the impulsive force described above, to maintain the speed constant, and thereby to improve the image quality, a rotational member having rotational resistance is caused to be in contact with the nonimage portion, that is, a corner portion which is not directly concerned with image formation, or the side surface of the rotational body so that sliding resistance is given to the rotational body.

When the rotational member having rotational resistance is contacted with the rotational body, a attenuation coefficient is increased, stabilization time of impulsive load variation such as pressure contact or release of a cleaning blade can be reduced, and thereby the oscillation can be rapidly absorbed. Due to the foregoing, the speed fluctuation of the rotational body caused when the load is varied, is decreased, and therefore, the image quality is greatly improved. Further the apparatus can be made compact, the cost is lowered, and further, reliability of the entire system can be increased.

The third embodiment of the present invention is constituted in the following manner: in order to rapidly absorb the speed fluctuation caused by the foregoing impulsive force, to maintain the constant speed, and thereby to improve the image quality, a blade made of rubber or a pad made of non woven fabric is caused to be in contact with non-image portion of the rotational body, that is, a corner portion which is not directly concerned with image formation, or the side surface of the rotational body so that sliding resistance is given to the rotational body.

When a blade or a pad is caused to be in contact with the rotational body, the stabilization time for impulsive load variation such as pressure contact or release of a cleaning blade can be reduced, and the oscillation can be rapidly absorbed. As a result of the foregoing, the speed fluctuation of the rotational body caused when the load is varied, is decreased, and the image quality can be greatly improved. Further, the apparatus can be made compact, the cost can be lowered, and further, reliability of the entire system can be increased.

DETAILED DESCRIPTION OF THE PREFERRED EMBODIMENT

Figure 1:
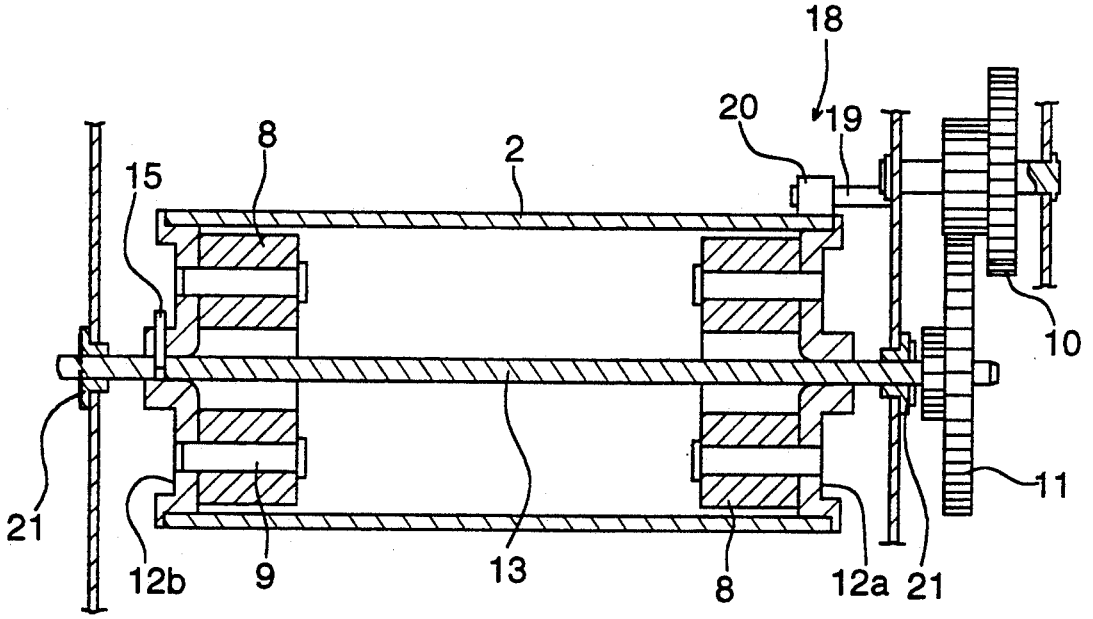
FIG. 1 is a sectional view showing an example of a photoreceptor drum of the present invention.

Referring to the drawings, the present invention will be described as follows.

Figure 2:
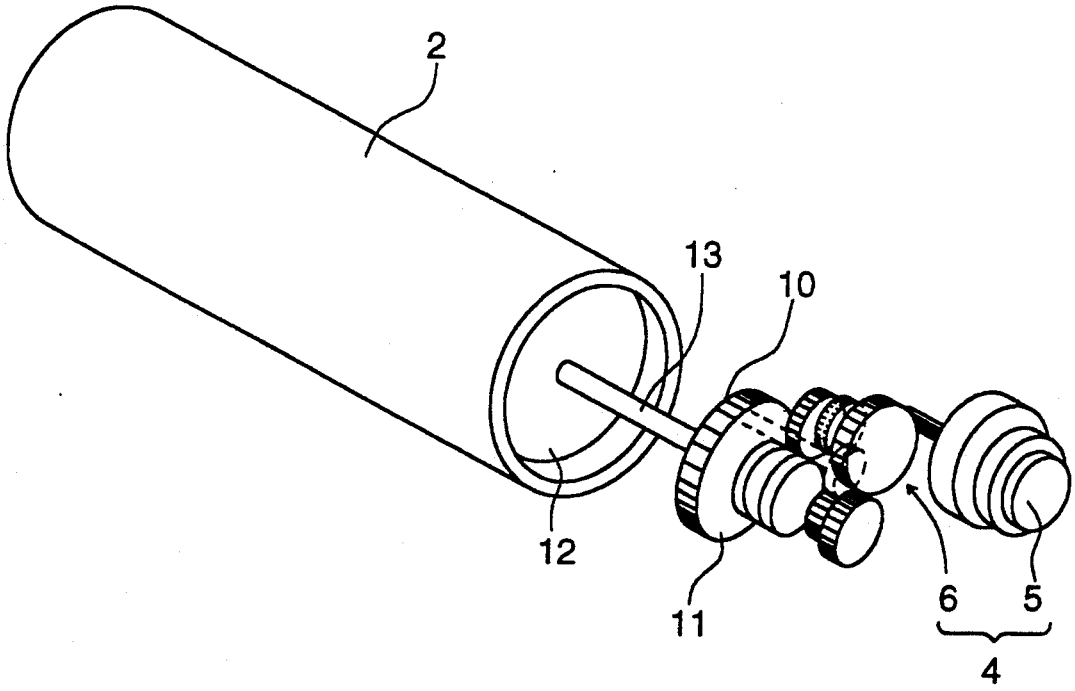
FIG. 2 is a perspective view showing an entire driving system of a rotational body of the present invention.
Figure 12:
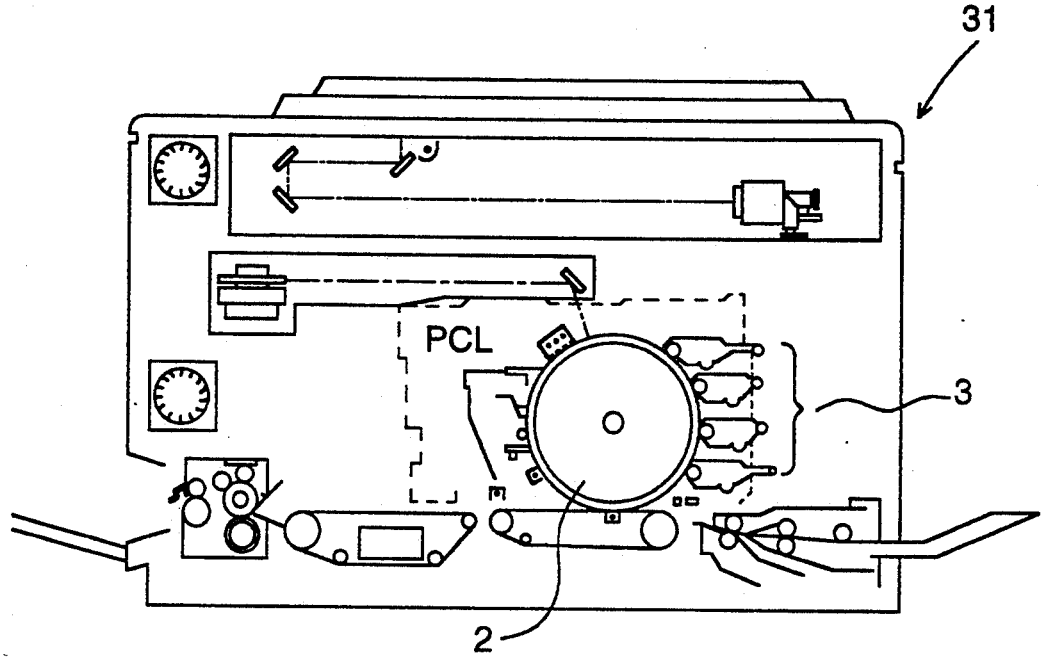
FIG. 12 is a schematic view showing an electrophotographic image output apparatus according to the present invention.

FIG. 12 shows the entire structure of an electrophotographic image output apparatus using a rotational body of the present invention. A photoreceptor drum 2 used for the rotational body, a developing section 3, and a driving mechanism, by which the photoreceptor drum 2 is driven, are provided in an electrophotographic output apparatus 31. The photoreceptor drum 2 and its driving mechanism 4 are shown in FIG. 2. The driving mechanism 4 is composed of a driving motor 5 and a gear group 6 connected therewith. A final gear 10 of the gear group 6 is connected with a driving gear 11 of the photoreceptor drum 2.

The photoreceptor drum 2 is composed of a cylindrical aluminum member, on the side of which organic light-sensitive material is coated, and flanges **12*a* and 12*b* are provided on both ends of the member as shown in FIG. 1. A drive shaft 13 is provided through the center of flanges 12*a* and 12*b*. The flange 12*b*, which is far from the driving gear 11, is fixed to the drive shaft 13 by a pin 15, and the flange 12*a* provided near the drive gear 11 is rotatably provided on the drive shaft 13. The drive shaft 13 is rotatably supported by a bearing 21, and the drive gear 11 is provided on the shaft end, and engaged with the final gear 10. Inertia members 8 are respectively provided to both flanges 12*a* and 12*b* inside the photoreceptor drum 2**.

The inertial members 8 are structured as follows: the inertial member 8 is made of steel material, stainless steel, brass material or the like; the material is formed into a ring; and rings are superimposed. The larger its specific gravity is, the more compact the inertial member 8 can be formed. Preferably, a ratio of moment of inertia I1 of the photoreceptor drum 2 to moment of inertia I2 of the inertial member 8 is within the range of 0.05 to 0.4.

Figure 3:
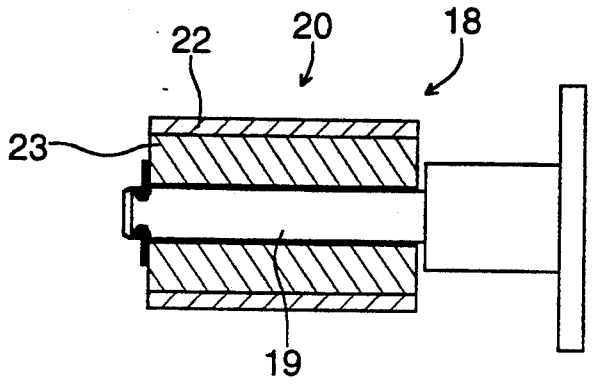
FIG. 3 is a sectional view showing a rotational member of the present invention.

A rotational member 18 is shown in FIG. 3. The rotational member 18 is composed of a support shaft 19 and a roller 20 which is rotatably provided on the support shaft 19, and a high viscosity oil is coated therebetween. The roller 20 is composed of a metallic inner cylinder 23 and an outer cylinder 22 which is made of rubber and by which the outside of the inner cylinder 23 is covered. The rotating member 18 is structured as follows: the roller 20 is in contact with a corner, that is, a portion which is not concerned with image formation, of the photoreceptor drum 2; and the support shaft 19 is provided so that it is in parallel with the drive shaft 13 of the photoreceptor drum 2. Accordingly, when the photoreceptor drum 2 is rotated, the roller 20 having viscous friction with the support shaft 19 is rotated, and thereby, the photoreceptor drum 2 is subjected to rotational resistance while being rotated.

Generally, the transfer function G(s) of oscillation is expressed by the following equation.

$$G(s) = \frac{\omega_N^2}{S^2 + 2\zeta\omega_N S + \omega_N} \quad \text{[Equation 2]}$$

In the equation, $\zeta$ is an attenuation coefficient, and $\omega N$ is the proper oscillation frequency. Equation 2 shows that when an attenuation coefficient $\zeta$ is increased, the transfer function G(s) is decreased.

FIGS. 5 to 8 show the difference between attenuation conditions when the attenuation coefficient $\zeta$ is changed. An axis of ordinates in each drawing indicates an amplitude, and an axis of abscissas indicates time. The attenuation coefficients $\zeta$ are 10% in FIG. 5, 20% in FIG. 6, 40% in FIG. 7, and 60% in FIG. 8. As a result of this, it can be found that the attenuation coefficient $\zeta$ is preferably within 20 to 60%.

As described above, the flange 12*b*, which is far from the drive gear 11, is connected with the drive shaft 13, the inertial member 8 is provided inside the photoreceptor drum 2, and the rotational member 18 is in contact with the photoreceptor drum 2. Therefore, moment of inertia I of the driving system composed of the photoreceptor drum 2, the drive shaft 13 and the drive gear 11, is increased. Further, the distance from the drive gear 11 to the inertial member 8 is increased, and the rigidity K of the driving system is practically decreased, so that the proper oscillation frequency of the driving system is lowered. Accordingly, when the proper oscillation frequency is set to an appropriate value, the following effects can be obtained: the proper oscillation frequency can be separated from the frequency of the fluctuation component in relation to the frequency of the fluctuation component generated in the driving mechanism 4; the resonance of the photoreceptor drum 2 can be prevented; the photoreceptor drum can be smoothly rotated without any speed fluctuation; and thereby, the image quality can be greatly improved.

Further, the following effects can be obtained: since rigidity K is practically decreased, the transfer gain of the photoreceptor drum 2 is lowered; therefore, the speed fluctuation which is caused by the final gear 10 is easily attenuated; the rotational speed fluctuation of the photoreceptor drum 2 can be lowered; since the rotational member 18 is in contact with the photoreceptor drum 2, the attenuation coefficient $\zeta$ of the photoreceptor drum 2 is increased; even when an instantaneous speed fluctuation is caused, for example, when the cleaning blade is pressed onto the photoreceptor drum 2, the speed fluctuation is rapidly attenuated, the speed is returned to the original one, and the rotational speed fluctuation can be minimized. Consequently, the image quality can be greatly improved.

Figure 4:
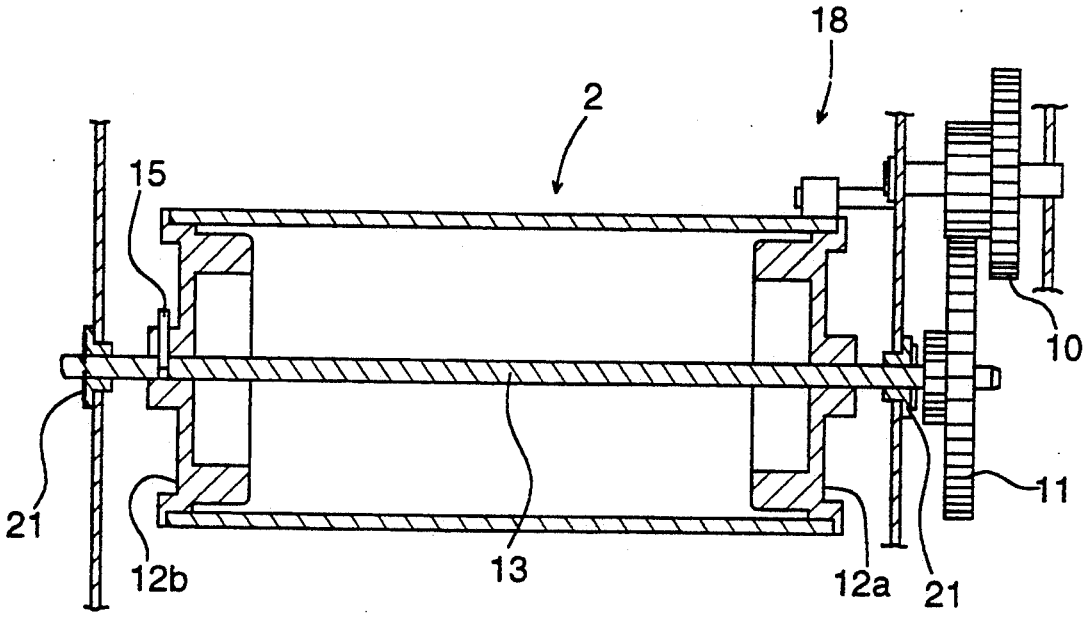
FIG. 4 is a sectional view showing another example of the photoreceptor drum of the present invention.
Figure 5:
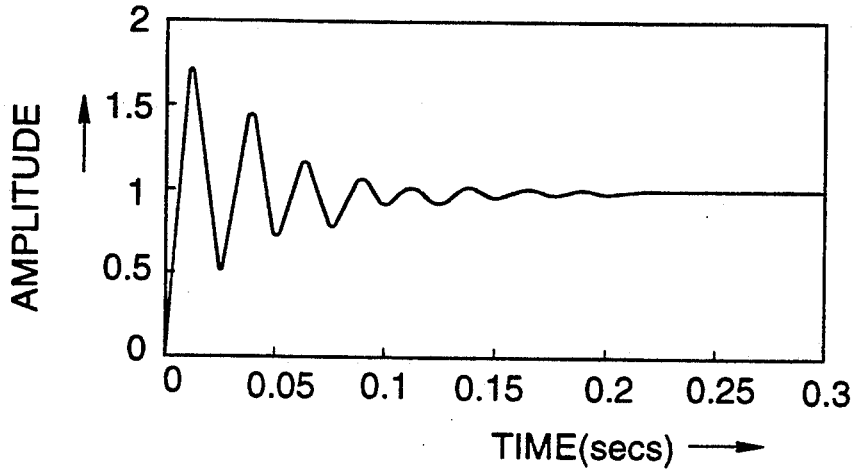
FIG. 5 is a graph showing attenuation condition of oscillation.
Figure 6:
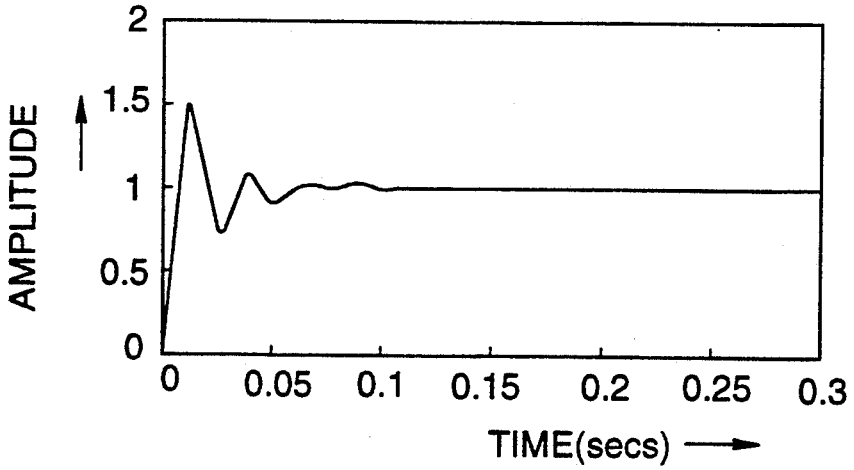
FIG. 6 is a graph showing attenuation condition of oscillation.
Figure 7:
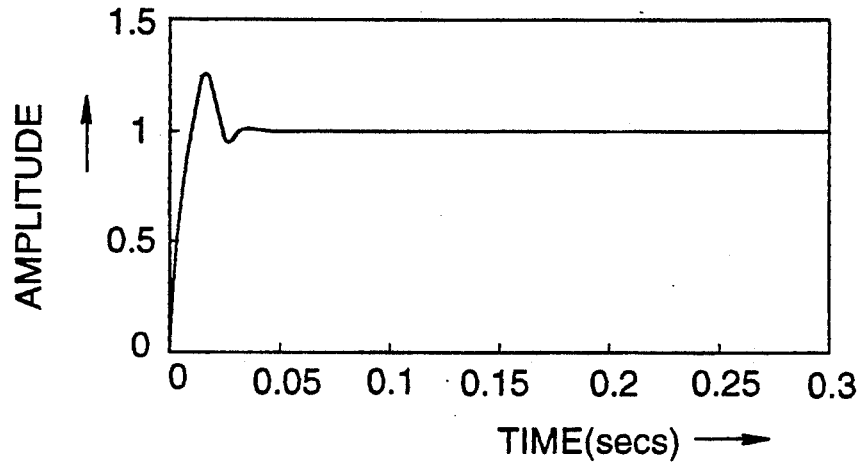
FIG. 7 is a graph showing attenuation condition of oscillation.
Figure 8:
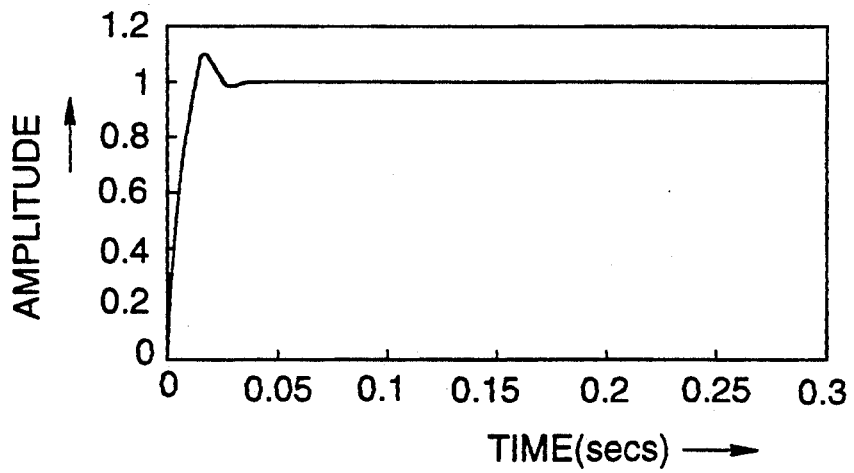
FIG. 8 is a graph showing attenuation condition of oscillation.

FIG. 4 shows another example of the photoreceptor drum 2. The flanges 12*a* and 12*b* are composed of members having a heavy inertial load, and the flange 12*a* is rotatably provided on the drive shaft 13. When moment of inertia I of the driving system is increased, the inertial load of the the flange itself may be increased as described above. In this way, as described above, the speed fluctuation is decreased, the image quality can be improved, assembling processes can be simplified, and the number of parts can be decreased, so that the cost can be lowered.

Further, the inertial member 8 may be structured in the following way: metallic plates in the form of thin plate are laminated; and they are fixed to flanges 12*a* and 12*b*. When the inertial member 8 is structured as described above, the following effects can be obtained: moment of inertia I of the photoreceptor drum 2 is increased; rigidity K is decreased and the proper oscillation frequency is decreased; as a result of that, the proper oscillation frequency can be separated from the frequency of the fluctuation component in the frequency area; the resonance can be prevented; the speed fluctuation of the photoreceptor drum 2 is decreased; and thereby, the image quality is greatly improved. Further, when the number of metallic plates are adjusted, moment of inertia I can be easily adjusted.

Figure 9:
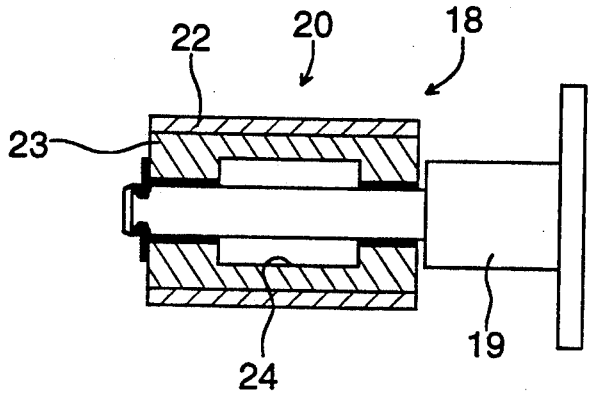
FIG. 9 is a sectional view showing another example of the rotational member.

Rotational resistance of the rotational member 18 can be appropriately set by selecting the viscosity of oil which is poured into a gap between the roller 20 and the support shaft 19. FIG. 9 shows another example of the rotational member 18. In the drawing, a groove 24 is formed along the circumference inside the inner cylinder 23, and a high viscosity oil is filled in the groove 24. When the rotational member 18 is structured as described above, oil starvation is not caused, and thereby stable viscosity resistance can be always obtained. Accordingly, the attenuation coefficient $\zeta$ of the photoreceptor drum 2 can be increased, the instantaneous speed fluctuation caused when the cleaning blade contacts the photoreceptor drum, is rapidly attenuated, and the constant rotational speed can be maintained.

Figure 10:
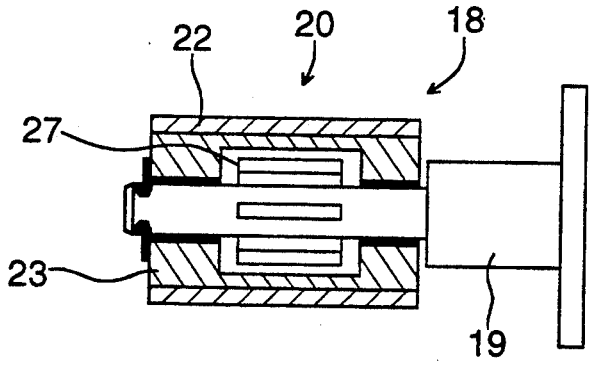
FIG. 10 is a sectional view showing yet another example of the rotational member.
Figure 11:
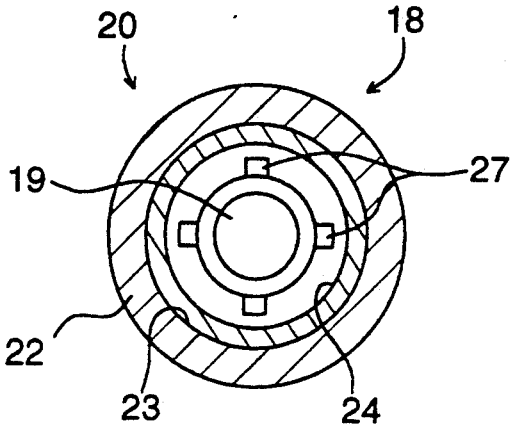
FIG. 11 is a sectional view showing another section of the example shown in FIG. 10.

Yet another example is shown in FIG. 10. The groove 24 is provided in the inner cylinder 23 in the same manner as that of the rotational member 18 shown in FIG. 9, and baffle plates 27 are provided on the support shaft 19 at four locations as shown in FIG. 11, and protruded towards the groove 24. When the rotational member 18 is structured as described above, in the case where the roller 20 of the rotational member 18 is rotated, the baffle plates 27 provided on the support shaft 18 prevent the viscous oil from being moved with the roller 20, and thereby larger resistance can be obtained. Accordingly, the attenuation coefficient $\zeta$ of the photoreceptor drum 2 can be increased, the instantaneous speed fluctuation caused when the cleaning blade touches the photoreceptor drum, is rapidly attenuated, and the constant rotational speed can be maintained. In this case, the baffle plates 27 may also be provided on the roller 20 side.

In the above example, the flange 12*a* is slidably provided on the driving shaft 13, however a sliding bearing or a ball bearing may be provided on the portion. When they are provided as described above, the dimensional accuracy between the driving shaft 13 and the flange 12*a* can be secured, and they can be more smoothly rotated, so that the image quality can be improved.

Figure 13:
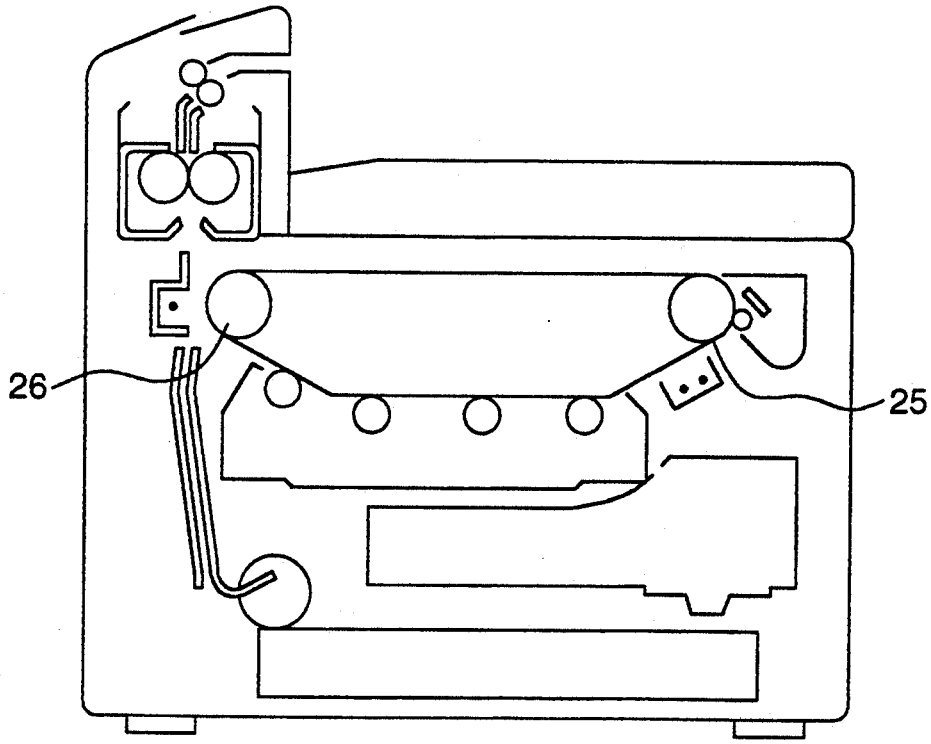
FIG. 13 is a schematic view showing an electrophotographic image output apparatus according to the present invention.
Figure 14:
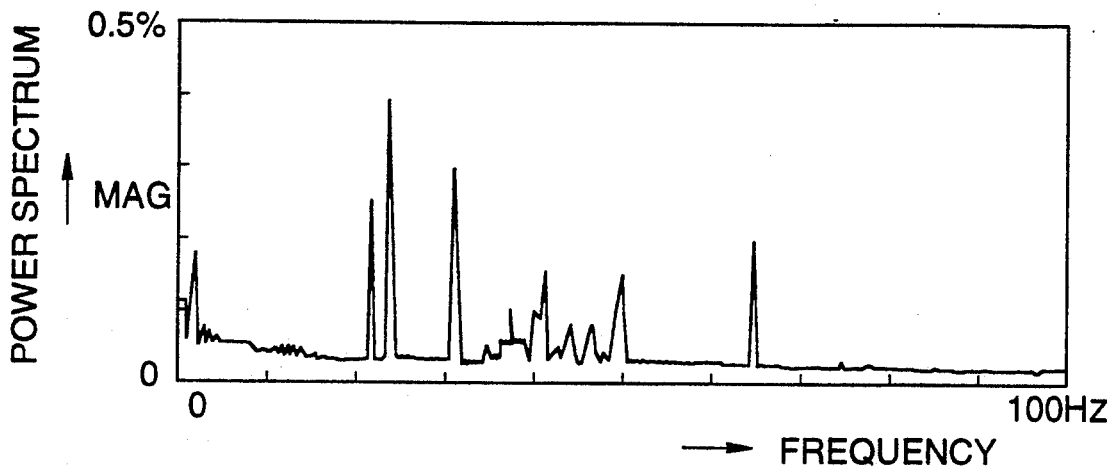
FIG. 14 is a graph showing speed fluctuation of a conventional photoreceptor drum.
Figure 15:
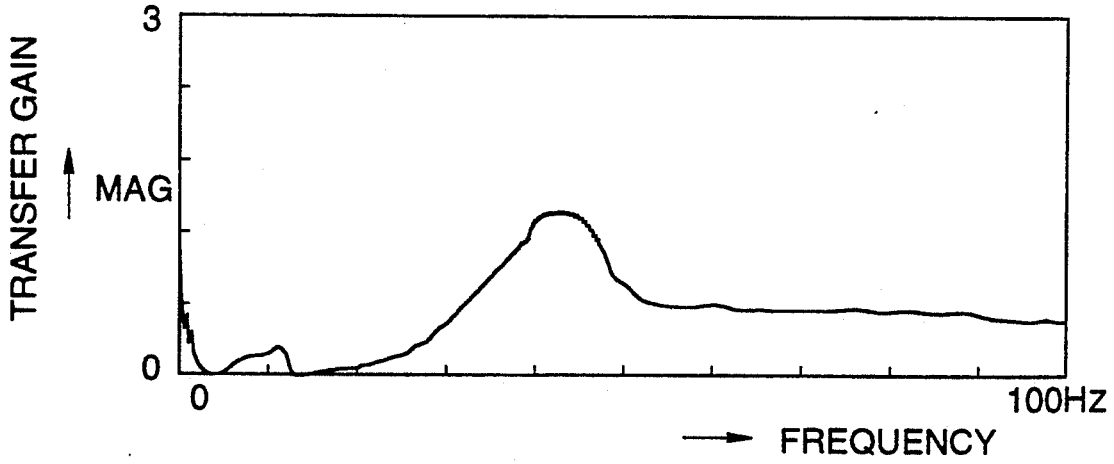
FIG. 15 is a graph showing transfer function of a conventional driving system of a photoreceptor.
Figure 16:
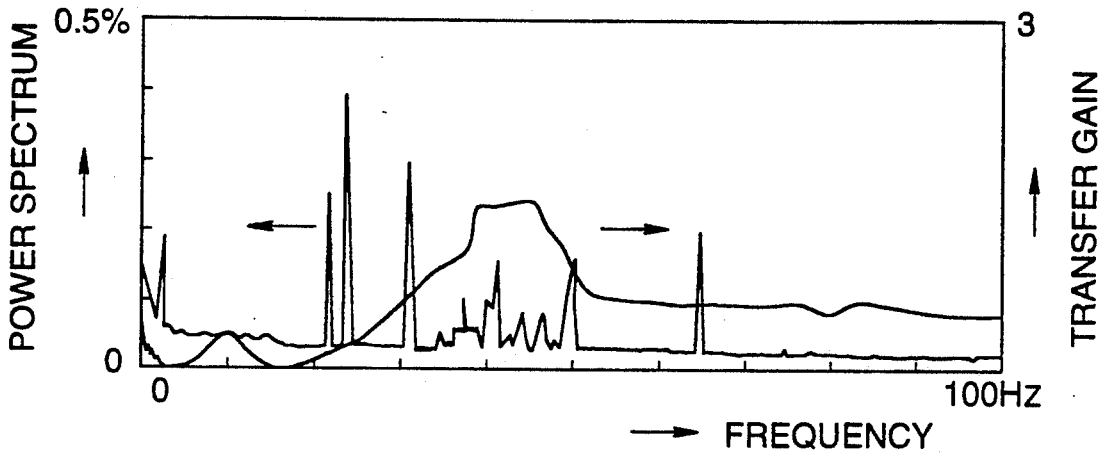
FIG. 16 is a graph in which a graph of speed fluctuation power spectrum of a conventional photoreceptor is shown together with that of transfer function of the driving system of the photoreceptor.
Figure 17:
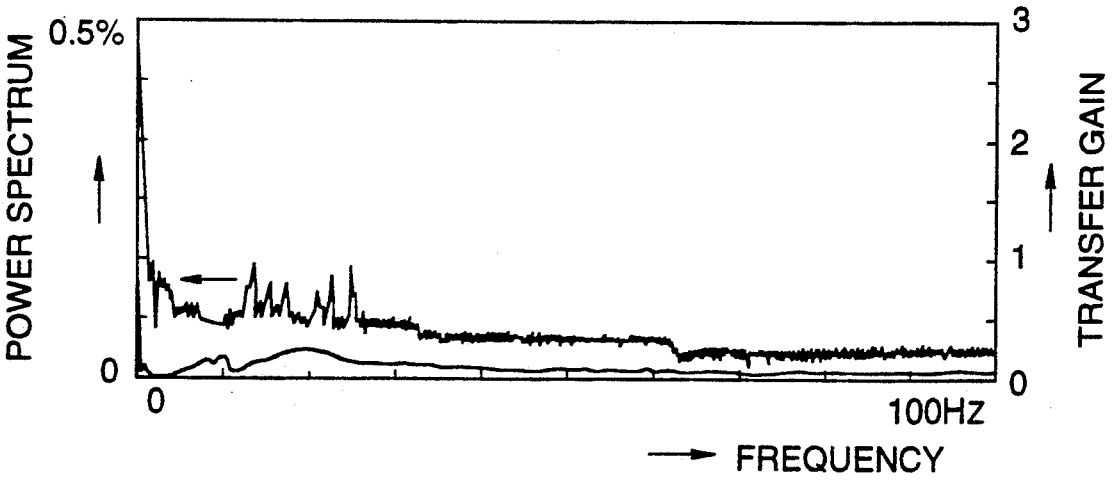
FIG. 17 is a graph in which a graph of speed fluctuation power spectrum of a photoreceptor is shown together with that of transfer function of the driving system of the photoreceptor when the proper oscillation frequency is increased.
Figure 18:
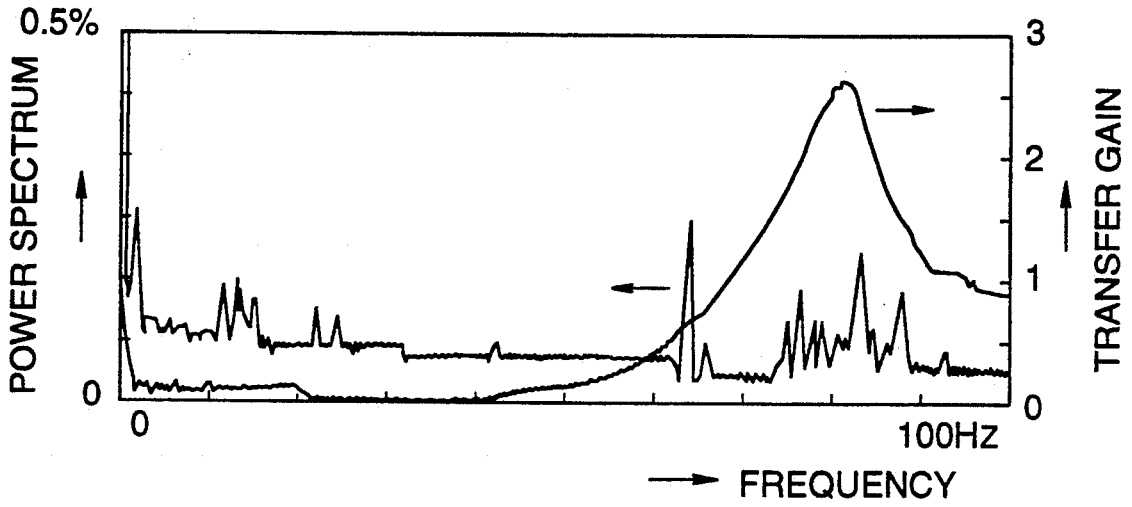
FIG. 18 is a graph in which a graph of speed fluctuation power spectrum of a photoreceptor is shown together with that of transfer function of the driving system of the photoreceptor when the proper oscillation frequency is decreased.
Figure 19:
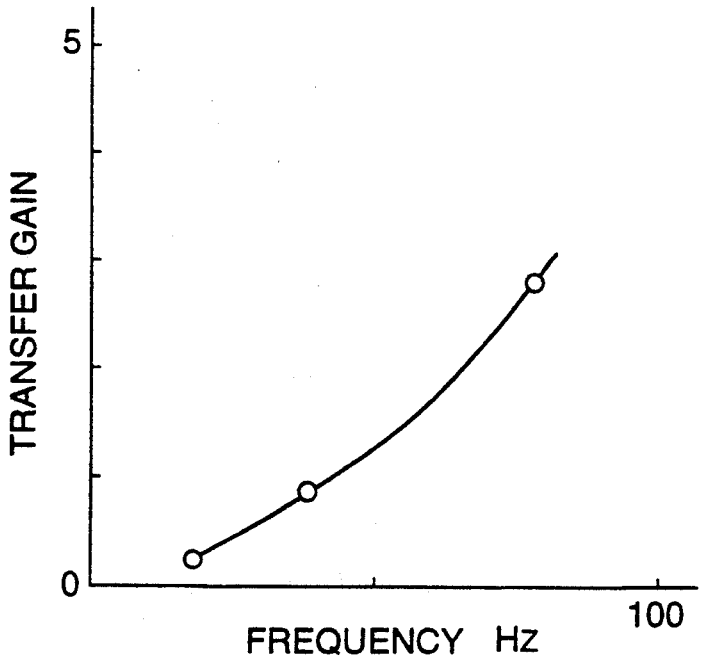
FIG. 19 is a graph showing a peak value of the transfer function of each driving system.

In the foregoing, the rotational body is the photoreceptor drum 2. However, the photoreceptor drum 2 does not necessarily need to be the rotational body of the present invention. As shown in FIG. 13, the photoreceptor drum 2 may be replaced with a belt-shaped photoreceptor 25 driven by a driving roller 26 to which the rotational body of the present invention is applied in an image output apparatus. Further, a rotational member 18 or a sliding member 50, which will be described later, may be provided in the apparatus. In this case, when the rotational body of each example described above is applied to the driving roller 26, the driving roller 26 can be rotated without any speed fluctuation.

Accordingly, the photoreceptor 25 can be conveyed at a constant speed, and therefore, the image quality can be greatly improved.

As described above, when the flange 12*b*, which is far from the driving gear 11, is fixed to the driving shaft 13 so that rigidity K is practically decreased; and the inertial member 8 is provided to the rotational body of the photoreceptor drum 2 or the like so that moment of inertia I of the rotational body driving system is increased, the proper oscillation frequency is lowered so that it does not match with the frequency of the speed fluctuation which is transmitted to the rotational body driving system. Accordingly, the following effects can be obtained: the resonance of the photoreceptor drum 2 or driving roller 26 can be prevented; the photoreceptor drum 2 or the photoreceptor 25 can be rotated or conveyed at a constant speed without any speed fluctuation; and thereby, the image quality can be greatly improved. Further, since rigidity K is practically decreased, the transfer gain of the photoreceptor drum 2 or the driving roller 26 is lowered, the speed fluctuation is hardly transmitted, the speed fluctuation of the photoreceptor drum 2 or the photoreceptor 25 can be decreased, and when the rotational member 18 is contacted with the non-image portion of the photoreceptor drum 2, the attenuation coefficient $\zeta$ of the photoreceptor drum 2 or the driving roller 26 can be increased, the instantaneous speed fluctuation caused by operations of the cleaning blade or the like, can be stabilized in a small period of time, and therefore the image quality is greatly improved. Further, the mechanism can be made compact, and thereby the apparatus can be made compact, so that the cost can be lowered. Further, reliability of the entire system is greatly increased.

Any combination of the inertial member 8 and the rotational member 18 in above examples may be acceptable.

According to the rotational body driving device of the present invention, in the rotational body driving system comprising the driving shaft, which is connected with the driving motor and driven thereby, and the rotational body which is connected with the driving shaft and rotated at a constant speed, when the flange which is far from the driving gear provided on the driving shaft, is fixed to the driving shaft, the inertial load is provided inside the rotational body, and further the sliding member is contacted with the non-image portion of the rotational body, the following effects can be obtained; the driving system can be set so that the proper oscillation frequency of the driving system is lowered, the frequency of the fluctuation component, which is generated by the driving motor and the rotation of the gear connected with the motor, does not match with the proper oscillation frequency; the resonance of the rotational body can be prevented; and the rotational body can be rotated without any speed fluctuation. Further, the rigidity is practically decreased; thereby the transfer gain of the rotational body driving system can be lowered; the transmission of the fluctuation can be prevented; the speed fluctuation of the rotational body can be decreased; attenuation coefficient $\zeta$ of the rotational body driving system can be increased when the rotational member is contacted with the rotational body; the instantaneous speed fluctuation can be stabilized in a short period of time; and therefore the image quality can be greatly improved. As a result of the foregoing, an uneven image, which is called jittering or an uneven pitch, which is generated particularly in the subsidiary scanning direction of the writing system, is decreased, and therefore the image quality can be greatly improved. Further, the apparatus, the mechanism of which is complicated, and the size of which is large in the conventional technology, can be made simple and compact, and thereby the cost can be lowered. Further, since the mechanism is made simple, the reliability of the entire system can be greatly improved.

Figure 20:
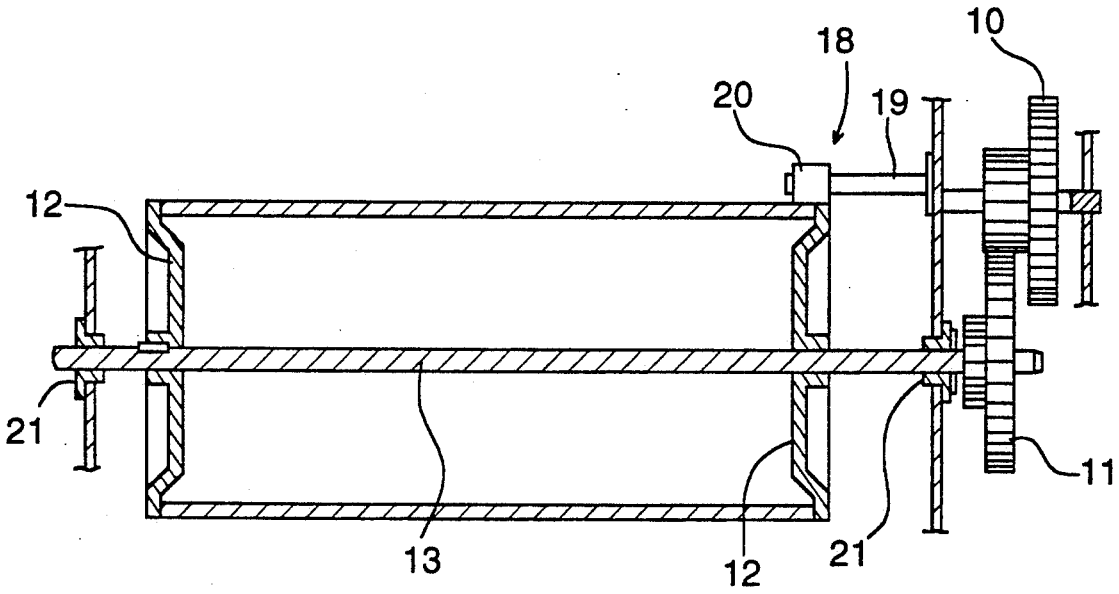
FIG. 20 is a sectional view showing yet another example of the photoreceptor drum of the present invention.

FIG. 20 is a sectional view of the photoreceptor drum 2 according to another example. The photoreceptor drum 2 is made of a cylindrical aluminum material, on the side of which an organic photosensitive material is coated, and on both ends of which flanges 12 are fixed. A driving shaft 13 is provided in the center of the flange 12. The driving shaft 13 is rotatably supported by a bearing 21. The driving gear 11 is provided on one end of the shaft, and engaged with the final gear 10. The rotational member 18, shown in FIG. 3, FIGS. 9, 10 and 11, is provided on the side of the flange 12, that is, on the wall of the image output apparatus 31.

As described above, since the roller 20 having viscous material between the support shaft 19 and the roller itself is made to be in contact with the photoreceptor drum 2 to rotate together with it, the attenuation coefficient $\zeta$ of the photoreceptor drum 2 is increased. Therefore, for example, even when the instantaneous speed fluctuation is caused in the case where the cleaning blade touches the photoreceptor drum 2, the speed fluctuation can be rapidly attenuated and the speed can return to the original one, and the the fluctuation of the rotational speed can be minimized. Accordingly, the instantaneous speed fluctuation can be rapidly attenuated, the photoreceptor drum 2 can be smoothly rotated at a constant speed, and thereby the image quality can be greatly improved.

According to the rotational body driving device of the present invention, when a roller having high viscous material between a support shaft and the roller itself is made to be in contact with a non-image forming portion of the rotational body to rotate together with it, the attenuation coefficient of the rotational body can be increased, and the rotational body can be constantly rotated at a predetermined speed irrespective of the speed fluctuation caused by the contact of a cleaning blade to the photoreceptor, or the like.

Figure 21:
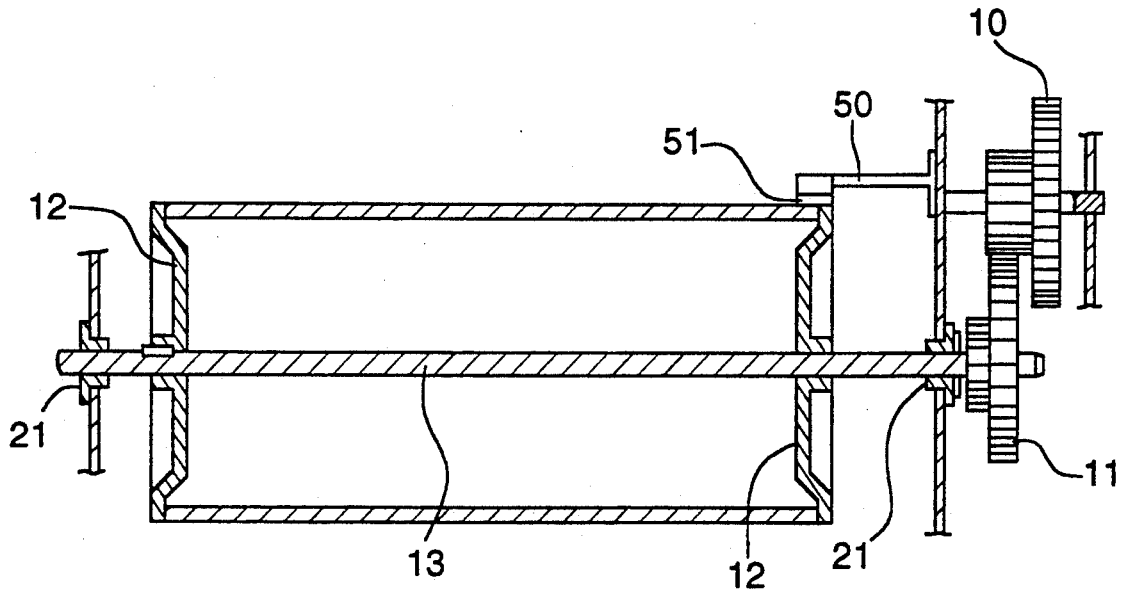
FIG. 21 is a sectional view showing yet another example of the photoreceptor drum of the present invention.

FIG. 21 is a sectional view of the photoreceptor drum 2 of another example. The photoreceptor drum 2 is made of a cylindrical aluminum material, on the side of which an organic photosensitive material is coated, and on both ends of which flanges 12 are fixed. A driving shaft 13 is provided in the center of the flange 12. The driving shaft 13 is rotatably supported by a bearing 21. The driving gear 11 is provided on one end of the shaft, and engaged with the final gear 10.

Figure 22:
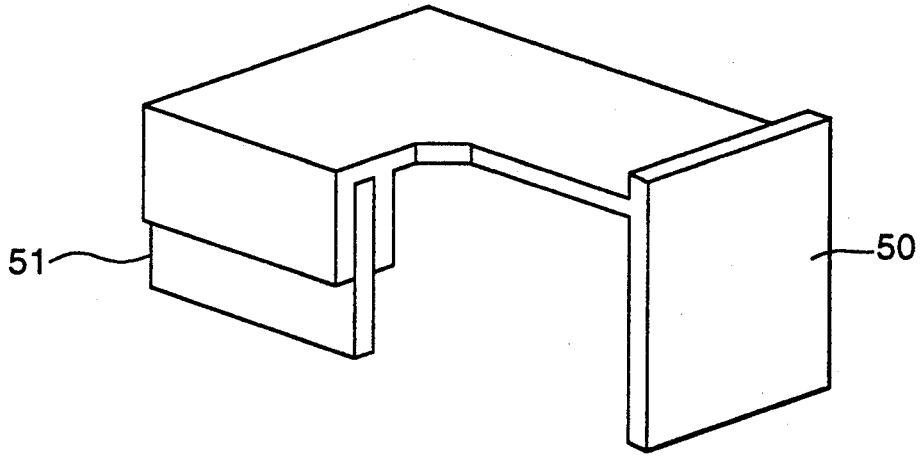
FIG. 22 is a perspective view showing a sliding member according to the present invention.

A sliding member 50 is provided on the side of the flange 12, that is, on a wall of the image output apparatus 31. The sliding member 50 is provided with a blade 51 made of silicone rubber on the end of the member as shown in FIG. 22, and the blade 51 is in contact with a corner of the photoreceptor drum 2, that is, a portion which is out of the image formation area. The sliding member 50 gives sliding resistance onto the photoreceptor drum 2 when the blade 51 is in contact with it. The sliding resistance can be appropriately set by adjusting the pressing force of the blade 51 or its material.

As an example, when HANENITE, which is a name of a product made by Naigai Rubber Industry, is used for the blade 19, the attenuation coefficient $\zeta$ of 18 to 35% can be obtained.

As a result of the foregoing, since the blade 51 of the sliding member 50 is in contact with the photoreceptor drum 2, the following effects can be obtained: the attenuation coefficient $\zeta$ of the photoreceptor drum 2 is increased; even when the instantaneous speed fluctuation is generated, for example, in the case where the cleaning blade touches the photoreceptor drum 2, the speed fluctuation can be rapidly attenuated so that the speed can return to the original speed; and the fluctuation of the rotational speed can be minimized. Accordingly, the instantaneous speed fluctuation can be rapidly attenuated, and thereby, the image quality can be greatly improved.

In the foregoing, it is also allowable according to the present invention that the sliding member 50 is not directly in contact with the surface of the photoreceptor drum 2, but it keeps contact with the flange 12 on the side. In the structure described above again, the attenuation coefficient $\zeta$ of the photoreceptor drum 2 can be increased, and the instantaneous speed fluctuation caused by the contact of the cleaning blade to the photoreceptor or the like, can be rapidly attenuated, so that the rotational speed can be maintained constant.

The material of the cleaning blade 51 provided on the tip of the sliding member 50, is not limited to silicone rubber, but urethane rubber, polyurethane rubber, and other high polymer material or elastic material may be used. Further, as another example, a blade 51 provided on the tip of the sliding member 50 may be replaced with a pad made of flocked fabric member, non woven fabric member, or other fabric member.

As described above, when the sliding member 50 is in contact with the non-image portion of the photoreceptor drum 2, the attenuation coefficient $\zeta$ of the photoreceptor drum 2 or the driving roller 26 can be increased, the instantaneous speed fluctuation caused by operations of the cleaning blade or the like, can be stabilized in a small period of time, and therefore the image quality is greatly improved. Further, the mechanism can be made compact, and thereby the apparatus can be made compact, so that the cost can be lowered. Further, reliability of the entire system is greatly increased.

According to the rotational body driving device of the present invention, when a sliding member composed of a blade or pad is brought into contact with a non-image forming portion of the rotational body to increase the attenuation coefficient of the rotational body, the rotational body can be constantly rotated at a predetermined speed irrespective of the speed fluctuation caused by the contact of a cleaning blade to the photoreceptor, or the like. As a result of the foregoing, an uneven image, which is called jittering or an uneven pitch, which is generated particularly in the subsidiary scanning direction of the writing system, is decreased, and therefore the image quality can be greatly improved. Further, the apparatus, the mechanism of which is complicated, and the size of which is large in the conventional technology, can be made simple and compact, and thereby the cost can be lowered. Further, since the mechanism is made simple, the reliability of the entire system can be greatly improved.

What is claimed is:

1. A driving device for driving a rotational photoreceptor in an image forming apparatus, comprising:

(a) driving means having (1) said photoreceptor in which an inertia member is attached and (2) a drive shaft for rotating said photoreceptor;

(b) means for transmitting a rotating force to said driving means, wherein said drive shaft is connected to said phtoreceptor at the side farthest from said transmitting means;

(c) a drive source for driving said transmitting means; and (d) a rotational member having a rotational resistance, being in contact with a non-image region of said rotational photoreceptor.

2. The driving device of claim 1, wherein the ratio of moment inertia of said photoreceptor to said inertia member is between 0.05 and 0.4.

3. The driving device of claim 1, wherein said rotational member comprises a roller and a support shaft around which said roller is rotatably attached and including a viscous substance applied between said roller and said support shaft.

4. The driving device of claim 3, wherein said roller comprises an inner metallic pipe and an outer rubber pipe covering said metallic pipe.

5. A driving device for driving a rotational photoreceptor in an image forming apparatus, comprising:

(a) driving means having (1) said photoreceptor and (2) a drive shaft for rotating said photoreceptor;

(b) means for transmitting a rotating force to said driving means;

(c) a drive source for driving said transmitting means; and (d) a rotational member having a roller and a support shaft around which said roller is rotatably attached and including a viscous substance applied between said roller and said support shaft, said rotational member being in contact with a non-image region of said photoreceptor in parallel with the axis of said photoreceptor.

6. The driving device of claim 5, wherein said rotational member has a space between said roller and said support shaft, said viscous substance is enclosed in said space.

7. The driving device of claim 6, wherein said rotational member further comprises a fin inside said space, said fin being attached to either said support shaft or said roller.

* * * * *